US008834071B2

(12) United States Patent
Vandenbulcke et al.

(10) Patent No.: US 8,834,071 B2
(45) Date of Patent: Sep. 16, 2014

(54) DEVICE FOR MANUFACTURING A FOUNDATION FOR A MASS LOCATED AT HEIGHT, ASSOCIATED METHOD AND ASSEMBLY OF THE DEVICE AND A JACK-UP PLATFORM

(75) Inventors: Luc Vandenbulcke, Kontich (BE); Koen Vanderbeke, Erps-Kwerps (BE)

(73) Assignee: GeoSea N.V., Zwijndrecht (BE)

( * ) Notice: Subject to any disclaimer, the term of this patent is extended or adjusted under 35 U.S.C. 154(b) by 116 days.

(21) Appl. No.: 13/401,488

(22) Filed: Feb. 21, 2012

(65) Prior Publication Data

US 2012/0213593 A1 Aug. 23, 2012

(30) Foreign Application Priority Data

Feb. 22, 2011 (BE) ..... BE2011/0119

(51) Int. Cl.

| | |
|---|---|
| ***E02D 5/00*** | (2006.01) |
| ***E02D 27/52*** | (2006.01) |
| ***E02D 13/04*** | (2006.01) |
| *E02B 17/00* | (2006.01) |

(52) U.S. Cl.

CPC ..... *E02D 13/04* (2013.01); *E02B 2017/0091* (2013.01); *E02D 27/52* (2013.01); *E02B 2017/0039* (2013.01)

USPC ..... 405/227; 405/224

(58) Field of Classification Search

USPC ..... 405/203, 208, 224, 225, 227

See application file for complete search history.

(56) References Cited

U.S. PATENT DOCUMENTS

| | | | | |
|---|---|---|---|---|
| 4,084,385 | A | 4/1978 | Boyadjieff | |
| 4,102,147 | A * | 7/1978 | Jansz | 405/228 |
| 4,120,166 | A * | 10/1978 | Brooks, Jr. | 405/225 |
| 4,739,840 | A | 4/1988 | Cox | |
| 4,892,445 | A * | 1/1990 | Paige | 405/224 |
| 5,244,312 | A | 9/1993 | Wybro et al. | |
| 5,988,949 | A * | 11/1999 | Will | 405/204 |
| 6,012,328 | A * | 1/2000 | Pohlmann | 73/84 |
| 6,808,337 | B1 * | 10/2004 | Thomsen | 405/203 |

FOREIGN PATENT DOCUMENTS

| | | | |
|---|---|---|---|
| EP | 2067915 | A2 | 6/2009 |
| EP | 2309063 | A1 | 4/2011 |
| GB | 2054710 | A | 2/1981 |
| WO | 03074795 | A1 | 9/2003 |
| WO | 2006109018 | A1 | 10/2006 |

* cited by examiner

*Primary Examiner* — Benjamin Fiorello

(74) *Attorney, Agent, or Firm* — The Webb Law Firm, P.C.

(57) ABSTRACT

A device for manufacturing a foundation for a mass located at height, such as the jacket of a wind turbine or a jetty, wherein the foundation comprises a quantity of piles driven into an underwater bottom in a geometric pattern. The device comprises a positioning framework of a number of mutually connected guide tubes arranged in a geometric pattern and adapted to receive and guide a pile to be driven into the underwater bottom, wherein the guide tubes comprise measuring means adapted to determine the height of a pile present in the guide tubes.

21 Claims, 14 Drawing Sheets

DEVICE FOR MANUFACTURING A FOUNDATION FOR A MASS LOCATED AT HEIGHT, ASSOCIATED METHOD AND ASSEMBLY OF THE DEVICE AND A JACK-UP PLATFORM

BACKGROUND OF THE INVENTION

1. Field of the Invention

The invention relates to a device and a method for manufacturing a foundation for a mass located at height, such as the jacket of a wind turbine or a jetty, wherein the foundation comprises a quantity of piles driven into an underwater bottom in a geometric pattern. The invention also relates to an assembly of a jack-up platform and a device coupled thereto with which the method can be performed.

2. Description of Related Art

The invention will be elucidated hereinbelow with reference to an offshore wind turbine. The reference to a wind turbine in no way implies that the invention is limited to the use in the context of such a wind turbine. The positioning framework and the method can likewise be applied on any other structure, such as jetties, radar and other towers, platforms and the like. The support structure of a wind turbine normally has a slender design, for instance in the form of a tube or pillar. This pillar structure has to be coupled to a foundation in the ground. For offshore wind turbines, which are placed in relatively shallow water, it is possible to make use of one mast extending from the machinery housing of the wind turbine to the foundation. In addition to such a monopole construction, the support structure of an offshore wind turbine can also comprise a tubular upper part and a lower part in the form of a lattice structure, also referred to as a jacket. A large part of the jacket extends underwater, where the jacket finds support on an underwater bottom, in many cases the underwater bottom.

A known method for providing a foundation for a mass located at height, such as the jacket of a wind turbine, comprises of providing an offshore platform in the vicinity of the location provided for the foundation, determining the location for each pile, subsequently manipulating each pile using a lifting crane present on the platform and driving each pile into the underwater bottom. Once all the piles have been arranged in the underwater bottom in the desired geometric pattern, thus forming the foundation, the jacket is arranged on the foundation formed by the quantity of piles by arranging legs of the jacket in the piles (also referred to as pin piling) or, in an alternative method, around the piles (also referred to as sleeve piling). The piles are adapted in both cases to be able to receive the legs of the jacket, for instance by providing hollow piles (pin piling) or hollow legs of the jacket (sleeve piling).

It will be apparent that it is of the greatest importance to not only urge the piles into the ground at the correct positions, but also to ensure that the piles are arranged substantially at a perpendicular angle in the underwater bottom. It is further of great importance that the height of the foundation piles arranged in the underwater bottom is the same, or in any case precisely known, before the jacket is arranged on the foundation piles. In view of the large dimensions of structures such as wind turbines, it is only possible in many cases to allow a maximum variation of 1° relative to the vertical direction. In order to determine the height of the piles arranged in the underwater bottom use is generally made of a diver or underwater robot which maps the situation in situ. This is time-consuming.

SUMMARY OF THE INVENTION

The invention has for its object to provide a device and method for providing a foundation as elucidated above with a greater accuracy than is possible with the known device and method.

The invention provides for this purpose a device which comprises a positioning framework of a number of mutually connected guide tubes arranged in a geometric pattern and adapted to receive and guide a pile to be driven into the underwater bottom, wherein the guide tubes comprise measuring means adapted to determine the height of a pile present in the guide tubes.

The guide tubes of the positioning framework are adapted to receive and guide piles when they are driven into the underwater bottom. If desired, they can be provided for this purpose with internal support ribs for the piles which extend over only a determined height of the guide tubes from the upper edge. In order to enable easy removal of the positioning framework once the piles have been arranged in the underwater bottom, the piles are generally driven to a position beyond the support ribs into the underwater bottom, whereby the piles are released from the support ribs. Because the device according to the invention comprises measuring means adapted to determine the height (of the upper surface) of a pile present in the guide tubes, it becomes possible to arrange the piles accurately in the underwater bottom, both in respect of their position and in respect of their height, whereby the angle of inclination relative to the vertical direction of a jacket placed on the foundation can be precisely set.

In a preferred embodiment of the device the measuring means comprise a liquid gauge (CLEM unit) adapted to measure the vertical height of a stop which is movable from a lower reference height up to at least the upper edge of a pile present in the guide tube and which can be coupled to the pile. An underwater liquid gauge is per se known. Such apparatus are able to perform depth measurements under water by means of a liquid height measurement, this independently of the water pressure (which can be high at typical depths), the temperature, the salt content and tidal currents, in contrast to conventional depth measurements which are based on the measurement of the water pressure. According to the present embodiment, the liquid gauge is coupled to the stop, for instance such that the liquid gauge co-displaces with the stop. The stop can be coupled to the pile and for instance be adapted to support on the upper edge of a pile driven into the underwater bottom. Once the stop has been coupled to a pile arranged in the underwater bottom, and is thus fixed in a measuring position, the height of the stop—and therefore the height of the (upper edge of the) pile—can be easily determined by reading the liquid gauge. Readout generally takes place through generation of an electrical signal which is carried via cabling suitable for the purpose to a data processor preferably present on the platform.

For proper operation it is advantageous to provide each guide tube with at least one liquid gauge with associated stop. A more accurate measurement is obtained when the guide tubes comprise a plurality of liquid gauges with associated stops, preferably liquid gauges with associated stops, for instance two, placed at regularly spaced distances from each other in the peripheral direction of the guide tube.

In a further preferred embodiment the measuring means comprise a displacement meter which is adapted to measure the displacement of a stop movable from a lower reference height to at least the upper edge of a pile present in the guide tube and which can be coupled to the pile, more preferably in combination with a liquid height difference meter, which substantially comprises liquid containers which are arranged on the guide tubes and which are mutually connected with a ring conduit, wherein the liquid containers are provided with liquid level meters. In respect of the relatively limited space it is recommended that the stop is the same as the stop used for the above described liquid gauge. According to the present embodiment the displacement meter is likewise coupled to the stop, for instance such that the displacement meter co-displaces with the stop. As already noted above, the stop can be coupled to the pile and adapted for instance to support on the upper edge of a pile driven into the underwater bottom. Once the stop has been coupled to a pile arranged in the underwater bottom, and is thus fixed in a measuring position, the height of the stop—and therefore the height of the (upper edge of the) pile—can be easily determined relative to a reference height by reading the displacement meter. Because the position of the liquid containers relative to the reference height of each guide tube is known, the differences in height of the reference heights of the guide tubes can be determined relative to each other by reading the liquid levels in the liquid height difference meters. The differences in height of the stops—and therefore also the differences in height between the piles—are hereby also determined relative to each other since the difference in height between the reference height and the stop height is known for each guide tube from the displacement measurement. The combined readout can be carried in the form of an electrical signal via cabling suitable for the purpose to a data processor preferably present on the platform.

The stop can in principle be embodied in any manner. In a preferred embodiment the stop is coupled movably to a vertical measuring rule provided on the outer side of the guide tubes, and the peripheral casing of the guide tubes comprises recesses in which the stop can be received at least from the lowest reference height up to a measuring height. Such an embodiment has the advantage that the measuring means are situated substantially on the outer side of the guide tubes, whereby the passage of the foundation piles is impeded less and maintenance and readout is made simpler.

A further preferred embodiment comprises a stop which is movable in the radial direction of the guide tube from a rest position, at a radius larger than the radius of the pile, to a measuring position at a radius smaller than the radius of the pile. By bringing the stop into the rest position a foundation pile can be driven relatively unobstructed through a guide tube into the underwater bottom. Once the pile is in position, the stop can be moved into measuring position by being moved downward from the upper side of the pile until the stop comes into contact with the upper edge of the associated tube. A simple and robust device is characterized in that the stop is connected to the measuring rule for pivoting around a horizontal axis and can be carried from the rest position to the measuring position (and vice versa) by rotation around this axis.

There are further advantages to characterizing the device according to the invention in that the measuring means comprise an inclinometer which is adapted for placing on the upper edge of a pile driven into the underwater bottom. Such an inclinometer is per se known and is preferably arranged on a support plate with transverse dimensions larger than the pile diameter. The support plate is for instance provided on the side facing toward the pile with a guide construction for the purpose of allowing it to support in relatively simple manner on the upper edge of a pile, wherein the guide construction extends partially in the pile. On the side facing away from the pile the support plate is provided with a lifting eye or the like with which the support plate can be lowered from for instance a platform onto the pile using a crane. If desired, the support plate can also be provided with a gyroscope in order to adjust possible inclination of the support plate.

In another aspect of the invention a device is provided in which the measuring means comprise a number of optical cameras. Such underwater cameras are per se known and can be mounted at a number positions on the positioning framework. It is advantageous to provide the positioning framework on the upper side of the guide tubes with a number of cameras which can monitor the passage of a foundation pile during driving thereof into the underwater bottom. It is also advantageous to provide a number of cameras at the position of readouts, for instance at the readout of the liquid height difference meters.

The positioning framework can optionally be moved along and under the guidance of the spud poles by any means known to the skilled person. It is thus possible for instance to suspend the positioning framework from a number of traction cables, wherein the cables can be varied in length by for instance winches arranged on the work deck of the platform. The cable length can be shortened or lengthened using the winches, wherein the positioning framework is respectively lifted or lowered. In a preferred embodiment of the invention the measuring means also comprise a tension meter for measuring the tension in the lifting cables. A suitable strain gauge comprises a bow shackle, the bow of which is provided with a force meter such as those based on the use of resistance strain gauges or a magnetic force meter.

If desired, the positioning framework can be provided with means for guiding the positioning framework along the spud poles of an offshore platform from a high position in the immediate vicinity of the work deck of the platform to a lower position, optionally onto or into the immediate vicinity of the underwater bottom. The guide means are preferably adapted such that they can guide the positioning framework along the spud poles of the platform so that the positioning framework is aligned substantially horizontally in the lower position. This can for instance take place by suspending the positioning framework by means of three, and preferably by means of four cables, wherein each cable can be varied in length independently of the other cables by winches. This is particularly important in the case of an underwater bottom which is not wholly flat.

The positioning framework according to the invention preferably comprises a lattice structure with a number of guide tubes which are disposed spaced apart at the corner points thereof and which are connected by tubular lattice elements. The dimensions of the positioning framework in the plane are in principle larger than the dimensions out of the plane, wherein the direction out of the plane corresponds to a direction parallel to the lifting or lowering direction of the positioning framework. The guide tubes are adapted to receive and guide the piles for driving into the underwater bottom, and preferably comprise cylindrical casings, the longitudinal axis of which runs parallel to the direction of the positioning framework out of the plane. The guide tubes are arranged in a geometric pattern, this pattern corresponding to the desired geometric pattern of the foundation piles. The tubular lattice elements extending between the guide tubes ensure that guide tubes remain substantially in their position during lifting and lowering of the positioning framework. In the present embodiment the positioning framework is adapted to define a specific geometric pattern of the foundation piles. It is however also possible to make the positioning framework geometrically adaptable, for instance by providing the positioning framework with lattice elements adjustable in length and/or by providing the positioning framework with nodes which mutually connect lattice elements and allow adjustment of the angle between lattice elements. Such an embodiment allows realization of different geometric patterns of the foundation piles.

The invention also relates to a method for manufacturing a foundation for a mass located at height, such as the jacket of a wind turbine or a jetty, wherein the foundation comprises a number of piles driven in a geometric pattern into an underwater bottom. The invented method comprises of providing a device according to the invention, lowering the positioning framework onto or into the immediate vicinity of the underwater bottom, driving the piles into the underwater bottom through the guide tubes of the positioning framework, and measuring at least the difference in height between the piles present in the guide tubes by means of the measuring device. The method more particularly comprises of firstly establishing the position for at least one pile and positioning the assembly of platform and positioning framework such that at least one guide tube of the positioning framework is situated directly above said pile position. The arranging of a first pile through the at least one guide tube fixes the positioning framework. In such a position the guide tubes for the other piles will automatically be located in their correct positions because their relative positions are determined by the geometric design of the positioning framework. A position determination for each individual pile is hereby no longer necessary. It is advantageous that the work deck of the platform be provided with at least one opening which is adapted for passage of a pile and which is vertically aligned with one of the guide tubes of the positioning framework, wherein an assembly of platform and positioning framework is positioned such that the opening (also referred to as moon pool) is located directly above said pile position and is aligned with one of the guide tubes. In such an embodiment the positioning framework is placed at least partially overlapping with the jack-up platform (preferably on the underside of the platform), wherein a significant part of the platform is overlapped. Arranging a first pile through the opening and the corresponding guide tube fixes the positioning framework in respect of the platform.

The foundation piles can be arranged in the underwater bottom in any manner, such as for instance by means of a pneumatic or hydraulic hammer, generally from the platform.

In another aspect of the invention a method is provided comprising the step of removing the positioning framework once at least the height difference has been measured, wherein the removal of the positioning framework is performed by lifting thereof, optionally with guiding by the spud poles, from the lower position to the high position in the vicinity of the work deck of the platform.

The invention further relates to a method for installing on a foundation a mass located at height, such as the jacket of a wind turbine or a jetty, wherein the foundation comprises a number of piles arranged by means of the above described method in an underwater bottom, the method comprising of arranging legs of the mass located at height into or around the piles and anchoring the legs to the piles by means of grouting.

The method according to the invention is particularly suitable for application with cylindrical (optionally) hollow foundation piles having an outer diameter of at least 1.2 m, more preferably at least 1.5 m, and most preferably at least 1.8 m, and with an (optional) wall thickness of 0.01 to 0.1 m, more preferably of 0.02 to 0.08 m, and most preferably of 0.04 to 0.06 m. A particularly suitable assembly according to the invention comprises at least one circular opening with a diameter of at least 1.5 m, more preferably at least 2.5 m and most preferably at least 3.0 m.

The method according to the invention is further particularly suitable for cylindrical (hollow) foundation piles with a length of more than 20 m, more preferably at least 25 m and most preferably at least 30 m, and a weight of 20 to 250 tonnes, more preferably of 60 to 200 tonnes and most preferably of 75 to 180 tonnes.

BRIEF DESCRIPTION OF THE DRAWINGS

The invention will now be elucidated in more detail with reference to the drawings, without otherwise being limited thereto. In the figures.

DETAILED DESCRIPTION

Figure 1:
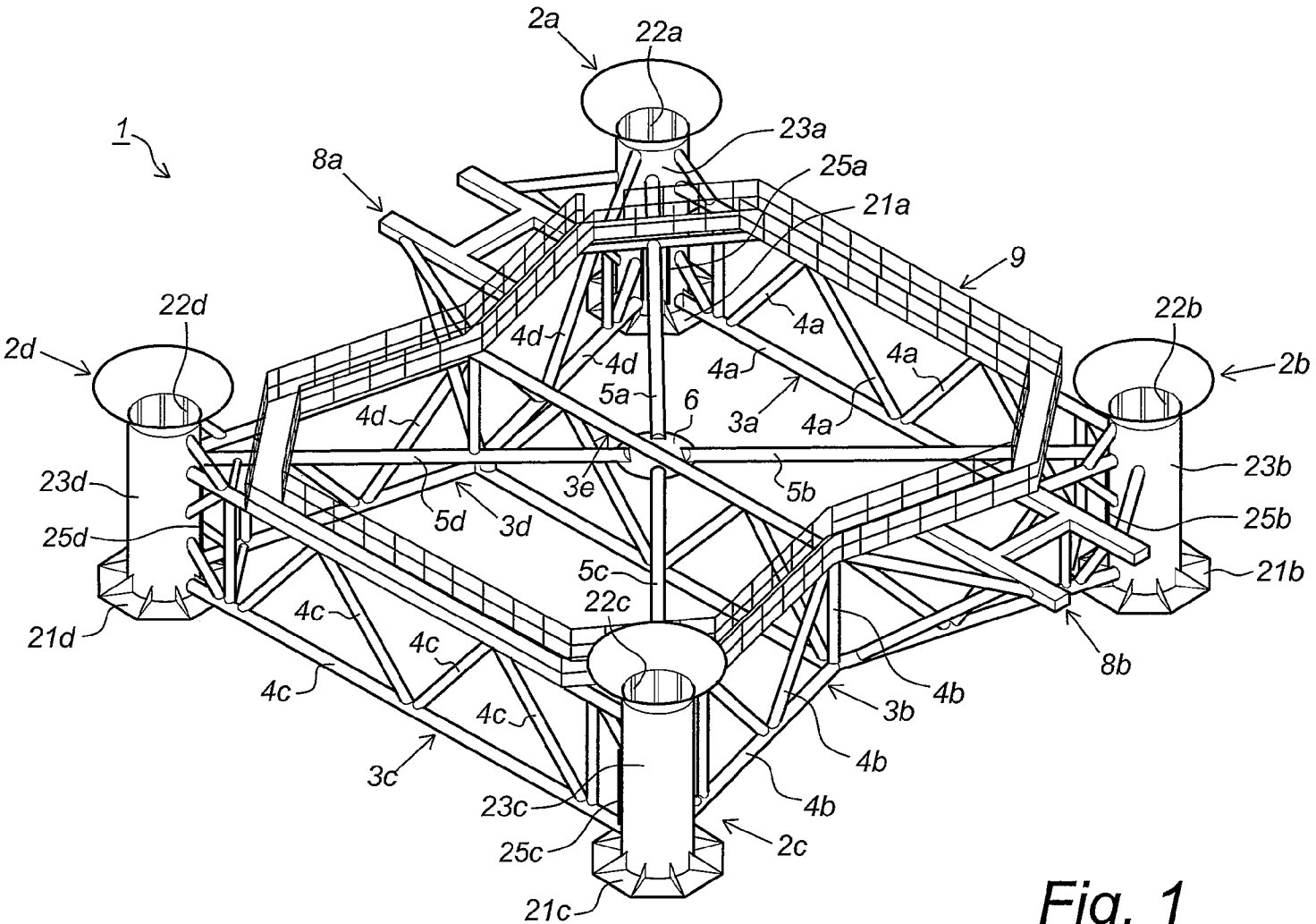
FIG. 1 shows a schematic perspective view of a device according to an embodiment of the invention.

Shown with reference to FIG. 1 is a device according to the invention in the form of a positioning framework 1 which comprises at the corner points four cylindrical guide tubes (2*a*, 2*b*, 2*c*, 2*d*) adapted to receive and guide a pile. Guide tubes (2*a*, 2*b*, 2*c*, 2*d*) are rigidly connected to each other by side lattices (3*a*, 3*b*, 3*c*, 3*d*) which are constructed from a relatively large number of tubular structural elements (4*a*, 4*b*, 4*c*, 4*d*). Cross braces (5*a*, 5*b*, 5*c*, 5*d*) connect the side lattices (3*a*, 3*b*, 3*c*, 3*d*) to a central connecting plate 6, whereby the lattice gains structural stiffness. Additional lattice elements can be added in order to build up sufficient stiffness.

Guide tubes (2*a*, 2*b*, 2*c*, 2*d*) are held in a fixed position relative to each other by the side lattices (3*a*, 3*b*, 3*c*, 3*d*) and the cross braces (5*a*, 5*b*, 5*c*, 5*d*), this such that guide tubes (2*a*, 2*b*, 2*c*, 2*d*) are arranged in a geometric pattern, this pattern being in the embodiment shown in FIG. 1 a quadrilateral with a side of about 20 m. Any other. geometric pattern is however possible, such as a triangle or other polygon, or for instance a circle.

Each guide tube (2*a*, 2*b*, 2*c*, 2*d*) comprises a cylindrical peripheral wall (23*a*, 23*b*, 23*c*, 23*d*) which is supported by a base plate (21*a*, 21*b*, 21*c*, 21*d*) and with which positioning framework 1 can find support on the underwater bottom. The internal surface of each guide tube (2*a*, 2*b*, 2*c*, 2*d*) is provided along at least a portion of the length of the guide tube with support ribs (22*a*, 22*b*, 22*c*, 22*d*) which support a pile during driving of the pile through the guide tube. The dimensions of guide tubes (2*a*, 2*b*, 2*c*, 2*d*) can be selected within wide limits, but have in the shown embodiment a height of about 6 m. As shown schematically in FIG. 1, guide tubes (2*a*, 2*b*, 2*c*, 2*d*) comprise measuring means (25*a*, 25*b*, 25*c*, 25*d*) which are adapted to determine the height of a pile 40 present in the associated guide tubes (2*a*, 2*b*, 2*c*, 2*d*).

Figure 2:
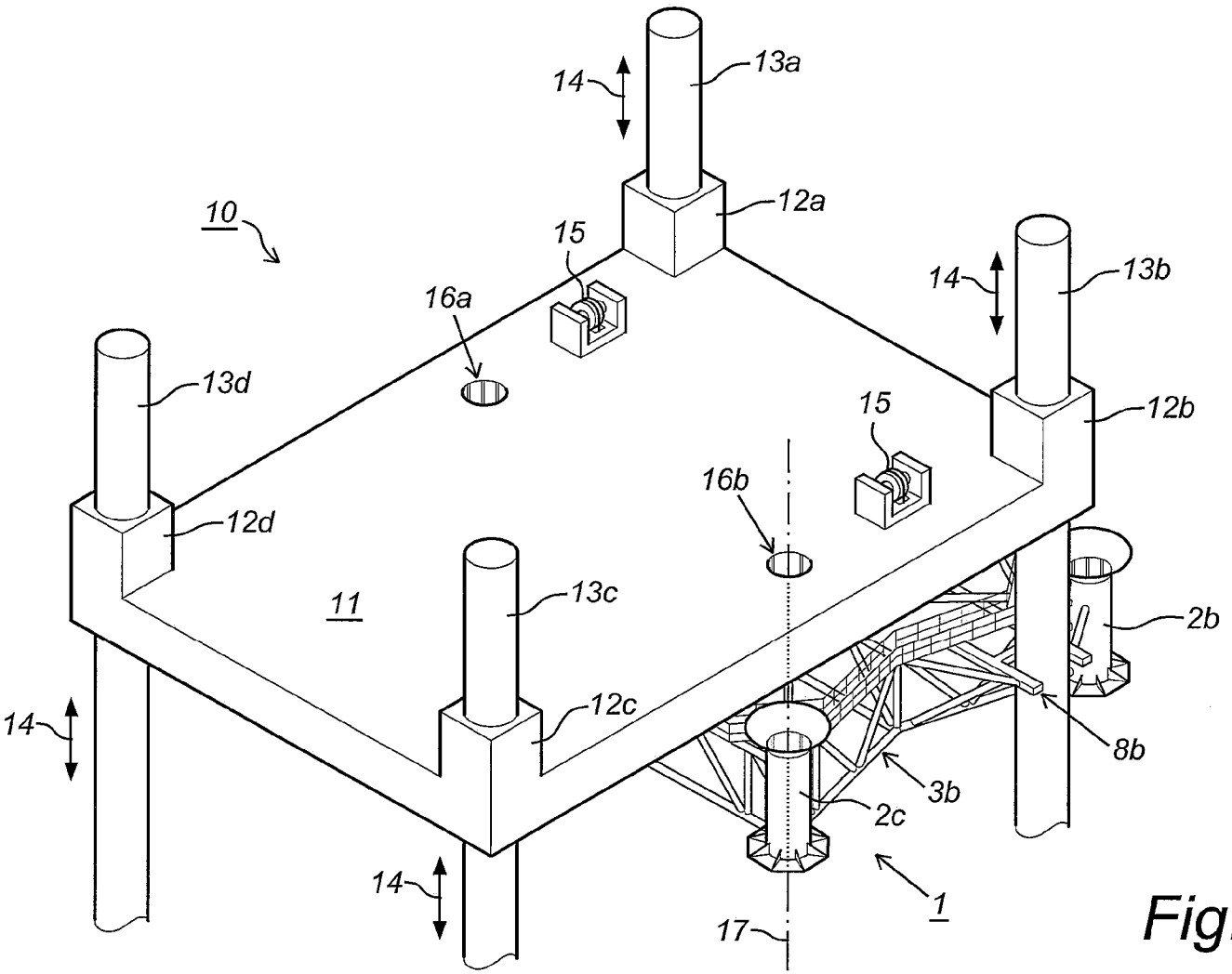
FIG. 2 shows a schematic perspective view of an assembly of a jack-up platform and a device according to an embodiment of the invention.

Positioning framework 1 is further providing the means for guiding positioning framework 1 along the spud poles of an offshore platform shown in FIG. 2. In the embodiment shown in FIG. 1 these means comprise a structure with two U-shaped end forks (8*a*, 8*b*) which are fixedly connected to the rest of positioning framework 1 by means of tubular elements. Positioning framework 1 is positioned relative to platform 10 such that a spud pole (13*a*, 13*b*, 13*c*, 13*d*) of platform 10 is partially received in the space between the outer legs (9*a*, 10*a*, 9*b*, 10*b*) of the U-shaped end forks (8*a*, 8*b*), the space being large enough to be able to receive a spud pole. Positioning framework 1 can in this way be guided downward and/or upward along the spud pole(s). The means for guiding the positioning framework 1 along spud poles (13*a*, 13*b*, 13*c*, 13*d*) of the platform also comprise lifting means, such as winches 15 provided on the work deck of platform 10.

A jack-up platform 10 adapted according to the invention is shown in FIG. 2. For reasons of clarity a number of structures, such as a lifting crane 18 (see FIGS. 3-9), normally present on a jack-up platform are omitted from the figure. Jack-up platform 10 comprises substantially a work deck 11 and four spud pole jacks (12*a*, 12*b*, 12*c*, 12*d*) at the corner points of work deck 11. Each jack (12*a*, 12*b*, 12*c*, 12*d*) operates a spud pole (13*a*, 13*b*, 13*c*, 13*d*) which can be lowered in the vertical direction 14 until the relevant spud pole finds support on underwater bottom 30 (FIG. 6). Work deck 11 is provided with winches 15 over which run cables which are connected to positioning framework 1. Using winches 15 the positioning framework 1 can be raised or lowered in the vertical direction 14. Platform 10 is further provided with two circular openings or moon pools (16*a*, 16*b*) which provide access to the water present under work deck 11 and which have a diameter which is large enough for passage of a foundation pile. Platform 10 thus carries the positioning framework 1, which in the shown preferred embodiment is provided on the underside of platform 10 in a rest position in the immediate vicinity of work deck 11 of platform 10. The assembly of platform 10 and positioning framework 1 is positioned such that moon pool 16*b* is vertically aligned with guide tube 2*c*, indicated in FIG. 2 with broken line 17.

Figure 3A:
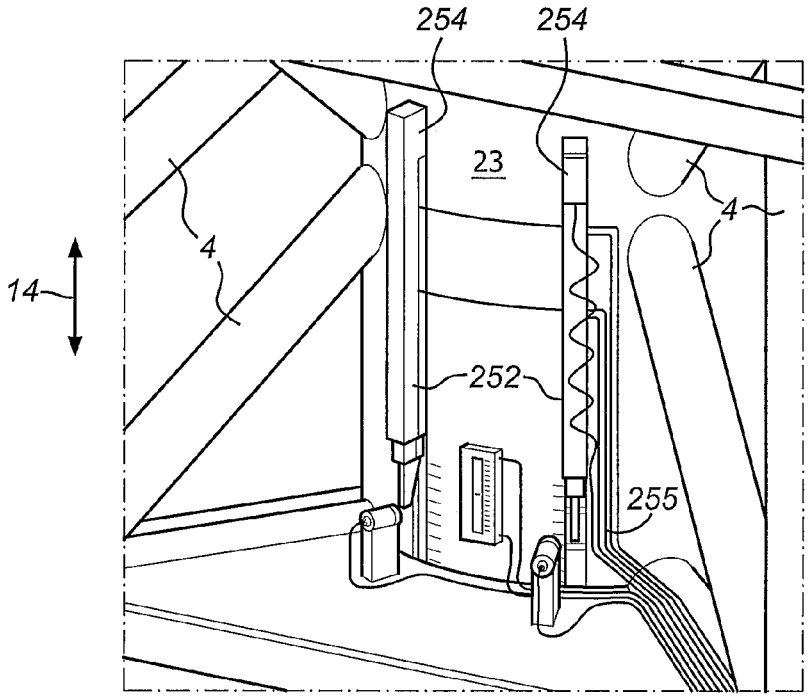
FIG. 3A shows a schematic view from the outer side of a guide tube with measuring means according to an embodiment of the invention.
Figure 3B:
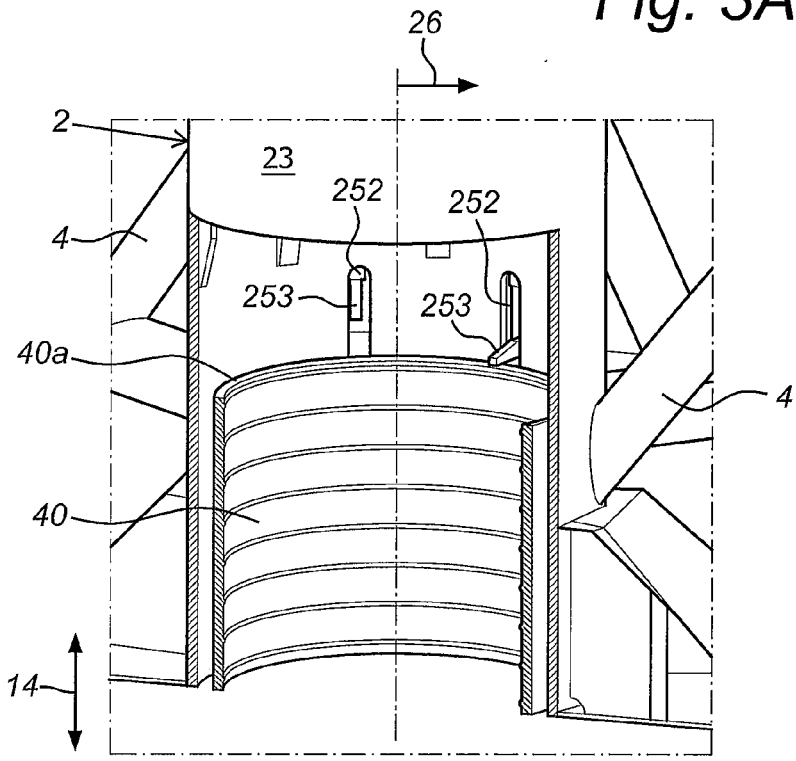
FIG. 3B shows a schematic view from the inner side of a guide tube provided with the measuring means according to the invention shown in FIG. 3A.
Figure 3C:
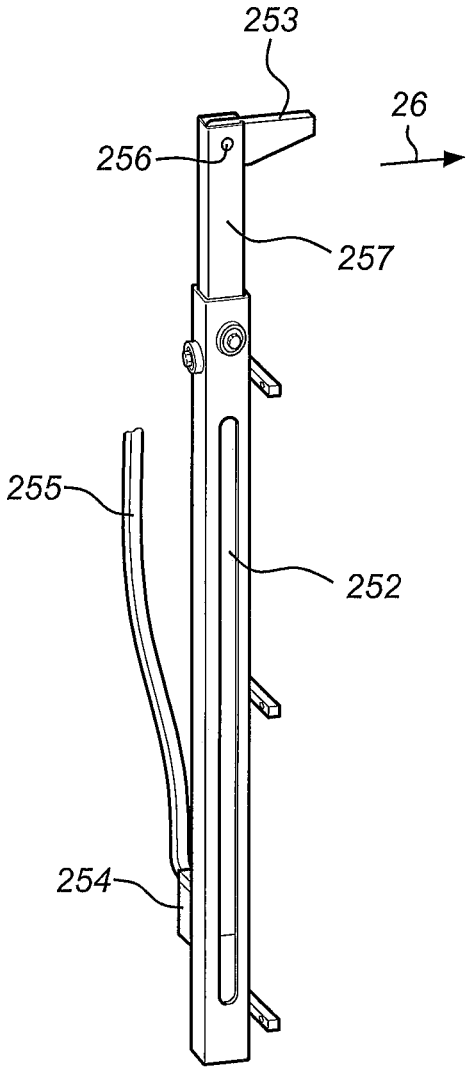
FIG. 3C shows a schematic detail view of a measuring rule with stop according to an embodiment of the invention.

Referring to FIGS. 3A-3C, measuring means 25 are arranged on the outer side of a guide tube 2 which are adapted to determine the height of a pile 40 present in guide tube 2. In the shown embodiment measuring means 25 comprise two measuring rules 252 mounted on casing surface 23 and each provided with a stop 253 and with a liquid gauge 254 which is adapted to measure (in known manner) the vertical height of stop 253. As shown in more detail in FIGS. 3B (in which a part of peripheral wall 23 of guide tube 2 is cut away in order to show the interior) and 3C, stop 253 is movable in vertical direction 14 from a lowest reference height (not shown) up to at least the upper edge 40*a* of a pile 40 present in guide tube 2. Stop 253 can be coupled to pile 40 by supporting on upper edge 40*a* of the pile 40 driven into the underwater bottom, so taking up a measuring position (see FIG. 3B). The liquid gauge 254 is coupled to stop 253 such that it can measure the height of stop 253 - and therefore the height of upper edge 40*a* of pile 40—once stop 253 has been fixed in the measuring position. Readout of the liquid gauge 254 generally takes place through generation of an electric signal which is carried via cabling 255 suitable for the purpose to a data processor (not shown) present on platform 10.

As shown in FIG. 3C, stop 253 is movable in the radial direction 26 of guide tube 2 from a rest position, at a radius larger than the radius of pile 40, to a measuring position at a radius smaller than the radius of pile 40. A simple manner of achieving this is to connect stop 253 pivotally around a horizontal axis 256 to measuring rule 252 (at least the movable part 257 thereof) and, by rotation around this axis 256 from the rest position (wherein stop 253 is folded down onto or into measuring rule 252), to carry the stop into the folded-out measuring position shown in FIG. 3C (and vice versa).

Figure 4:
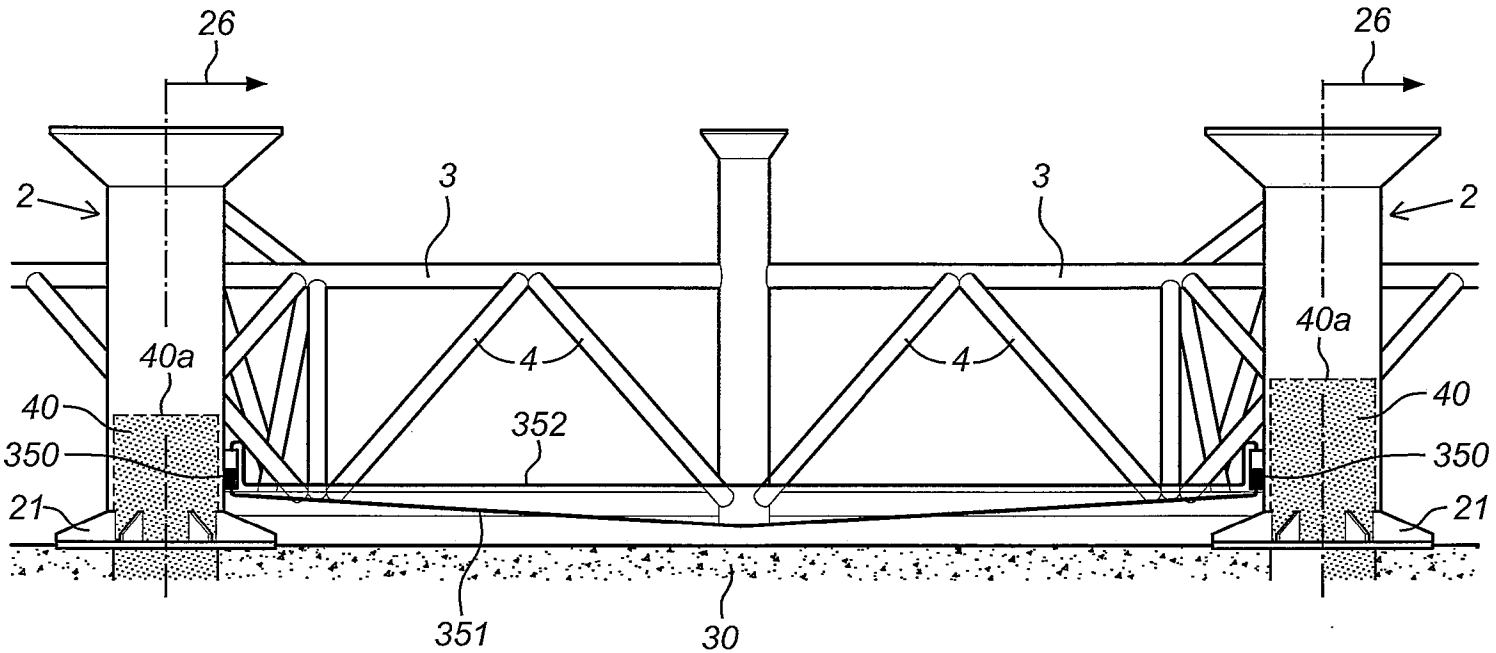
FIG. 4 shows a schematic side view of a liquid height difference meter according to an embodiment of the invention.

In another preferred embodiment the measuring means comprise a displacement meter adapted to measure the displacement of stop 253. The displacement meter is not shown in FIGS. 3A-3C, but will occupy a similar position to the liquid gauge 254 and is coupled in the same manner as already described above to measuring rules 252 provided with the stop 253. Using the displacement meter the height of stop 253—and therefore the height of upper edge 40*a* of pile 40—can be determined relative to a reference height, which is for instance at the underside of guide tube 2. A displacement meter is generally applied in combination with a liquid height difference meter (350, 351, 352) as shown in FIG. 4 which substantially comprises liquid containers 350 arranged on guide tubes 2. Liquid containers 350 are provided with liquid level meters (not shown) and mutually connected with a ring conduit 351. The top side of liquid containers 350 is connected to an air pressure conduit 352 which compensates possible pressure differences between liquid containers 350. The position of liquid containers 350 relative to a reference height of each guide tube 2 is known. The differences in height of the reference heights of guide tubes 2 relative to each other can hereby be determined by reading the liquid levels in the liquid height difference meters (350, 351, 352) of each guide tube 2. By adding these measurements to the differences in height between the reference height and the stop height per guide tube measured by the displacement meters the differences in height of stops 253—and so also the differences in height between piles 40 in different guide tubes 2—can be determined relative to each other. The combined readout can be carried in the form of an electrical signal via cabling 255 suitable for the purpose to a data processor (not shown).

Figure 5:
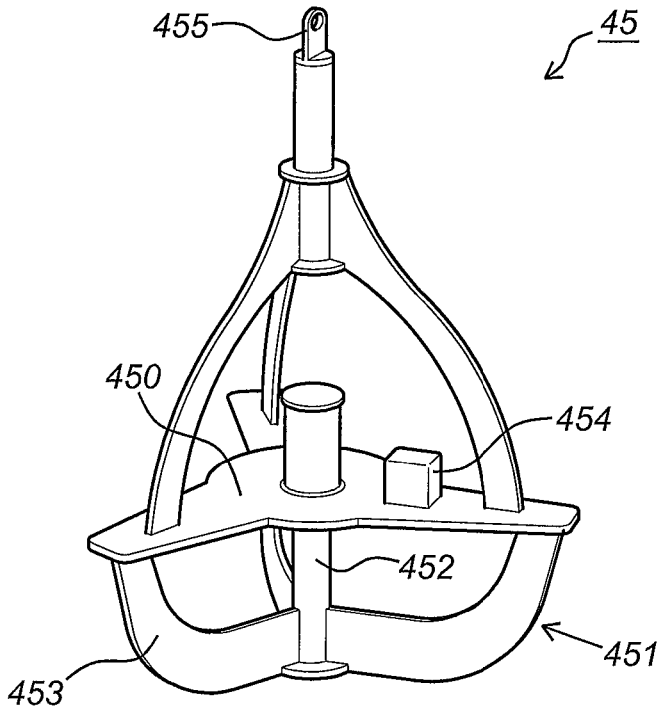
FIG. 5 shows a schematic perspective view of an inclinometer according to an embodiment of the invention.
Figure 6:
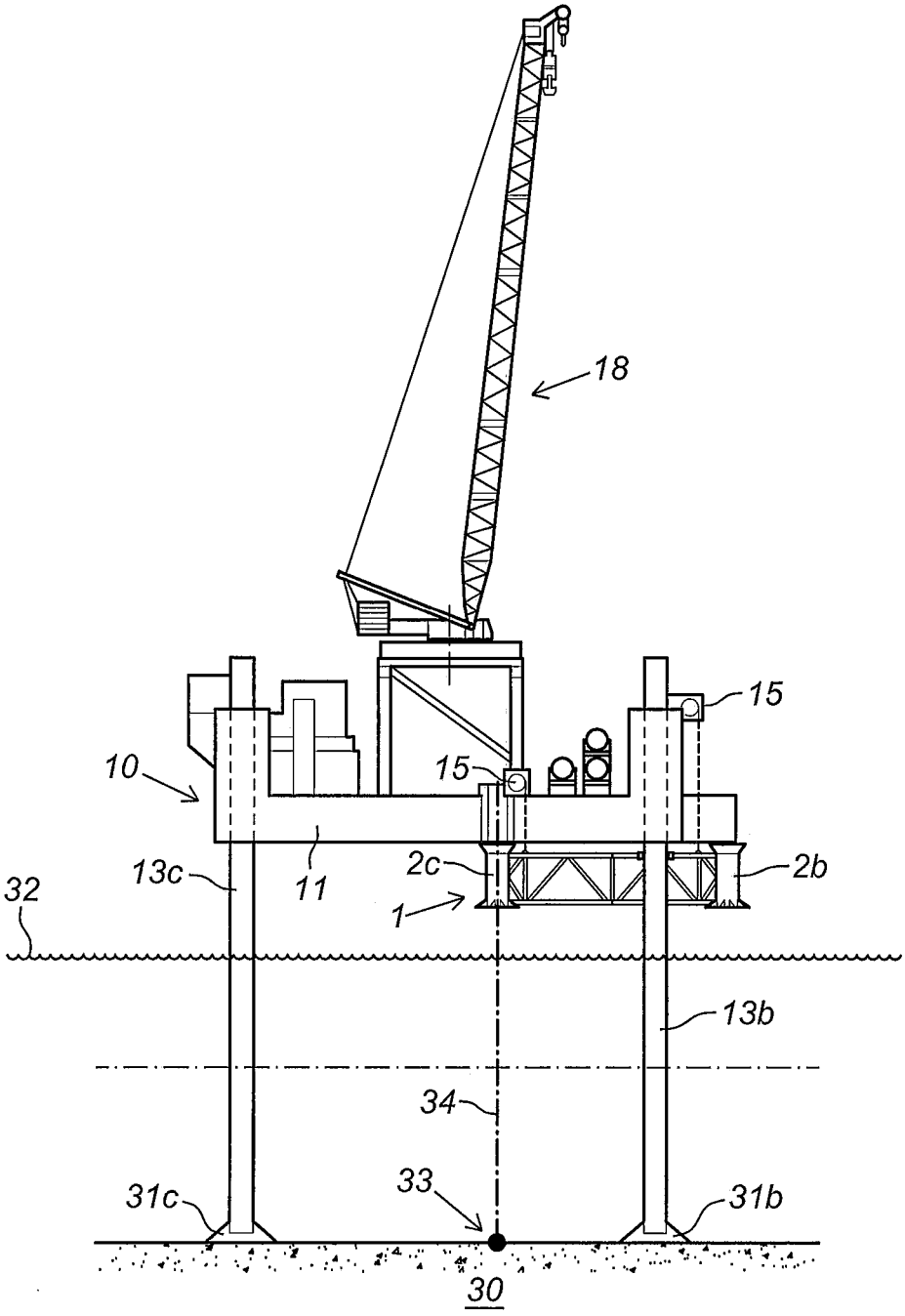
FIG. 6-12 show schematic side views of an assembly of platform and positioning framework in a number of positions occupied in different steps of the method.

Referring to FIG. 5, an inclinometer 454 according to an embodiment of the invention is shown. Inclinometer 454 is mounted on the three-legged support plate 450 of a carrying construction 45. Support plate 450 has transverse dimensions larger than a pile diameter so that it can rest with the plate legs on upper edge 40*a* of a pile 40. Support plate 450 is provided on the side facing toward the pile with a guide construction 451 in the form of three curved plates 453 running from the legs to central axis 452. Owing to the curvature of curved plates 453 the carrying construction 45 will find support relatively easily on upper edge 40*a* of pile 40; after all, guide construction 451 will readily drop partially into pile 40. On the side facing away from the pile the support plate 450 is provided with a lifting eye 455 with which carrying construction 45 can be lowered using a crane for instance from a platform 10 onto a foundation pile 40. Support plate 450 is also provided with a gyroscope 456 for the purpose of adjusting possible inclination of support plate 450. The operation of an inclinometer 454 is per se known to the skilled person.

An embodiment of the method according to the invention is shown in a number of steps in FIGS. 6 to 12. Referring to FIG. 6, the step is shown of determining the desired position 33 of a first pile for urging into the underwater bottom 30 and of positioning the assembly of platform 10 and positioning framework 1, this in a manner such that a guide tube (in the shown embodiment guide tube 2*c*) of positioning framework 1 is vertically aligned with said pile position 33, as represented schematically by broken line 34. Spud poles (13*a*, 13*b*, 13*c*, 13*d*) of platform 10 support in the fixed position on or partially in the underwater bottom 30 by means of removable feet (31*a*, 31*b*, 31*c*, 31*d*). Positioning framework 1 is held in position by winches 15 which operate lifting cables 35. In the rest position of positioning framework 1 the length of lifting cables 35 will be relatively short.

Figure 7:
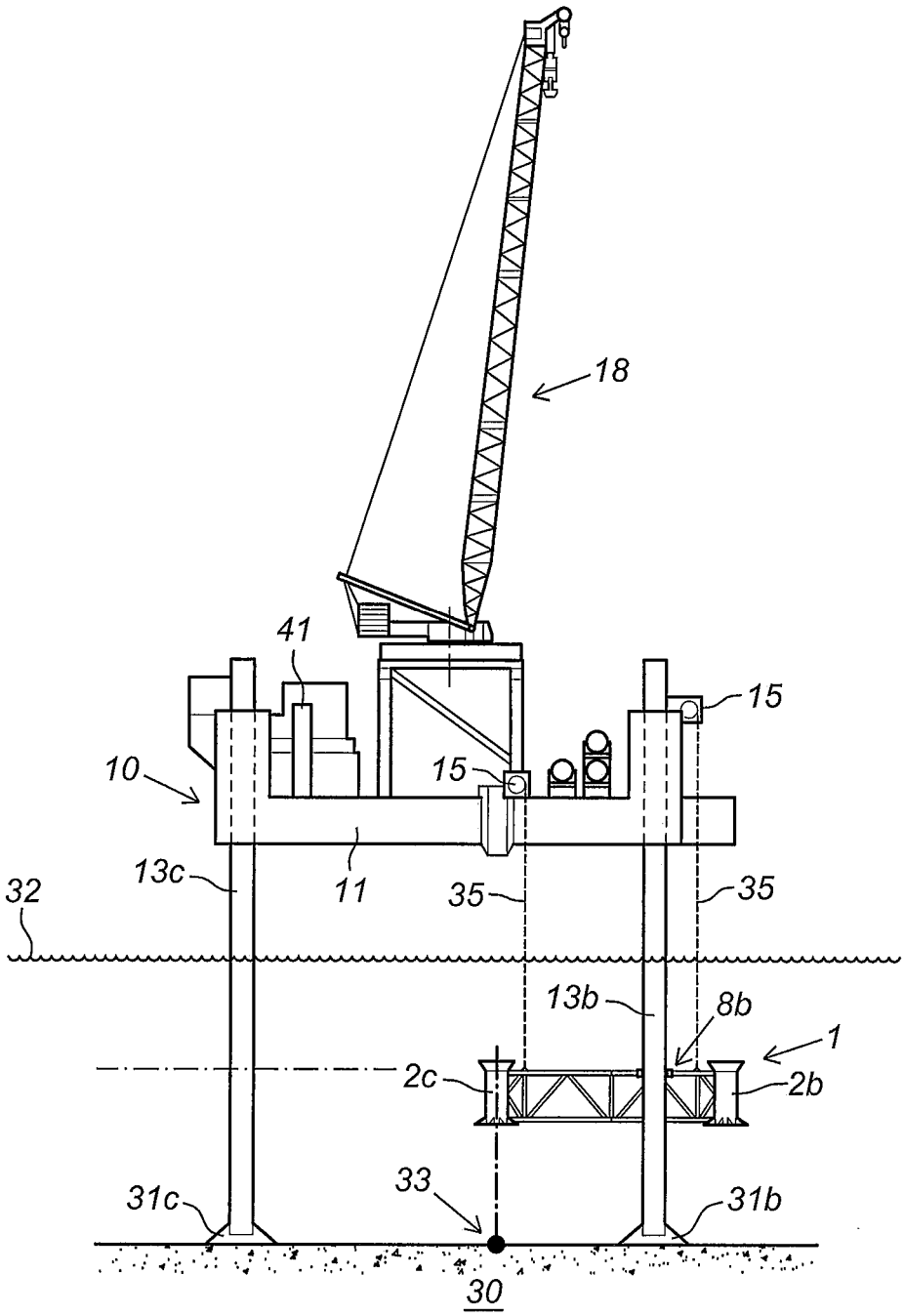
Figure 8:
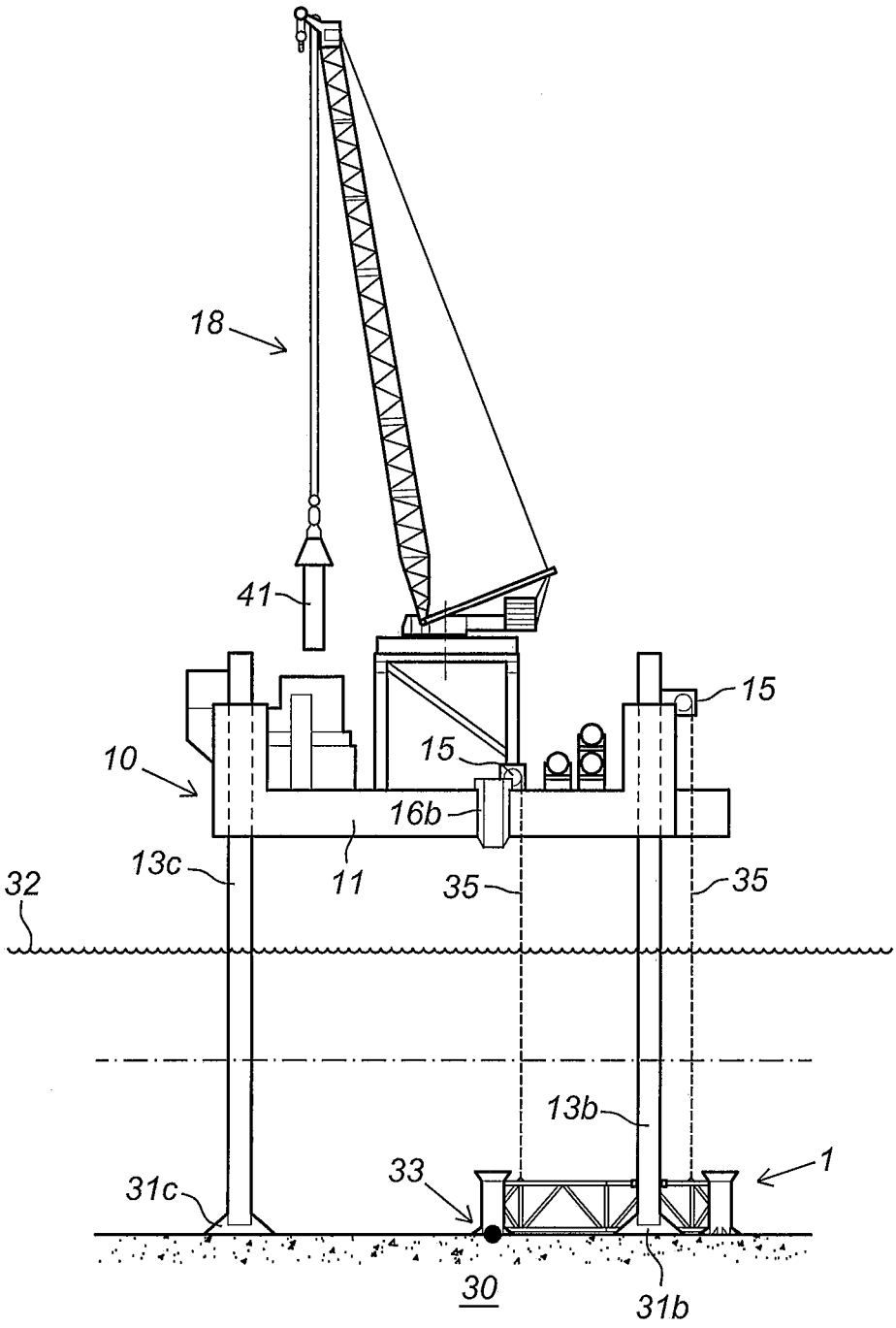
Figure 9:
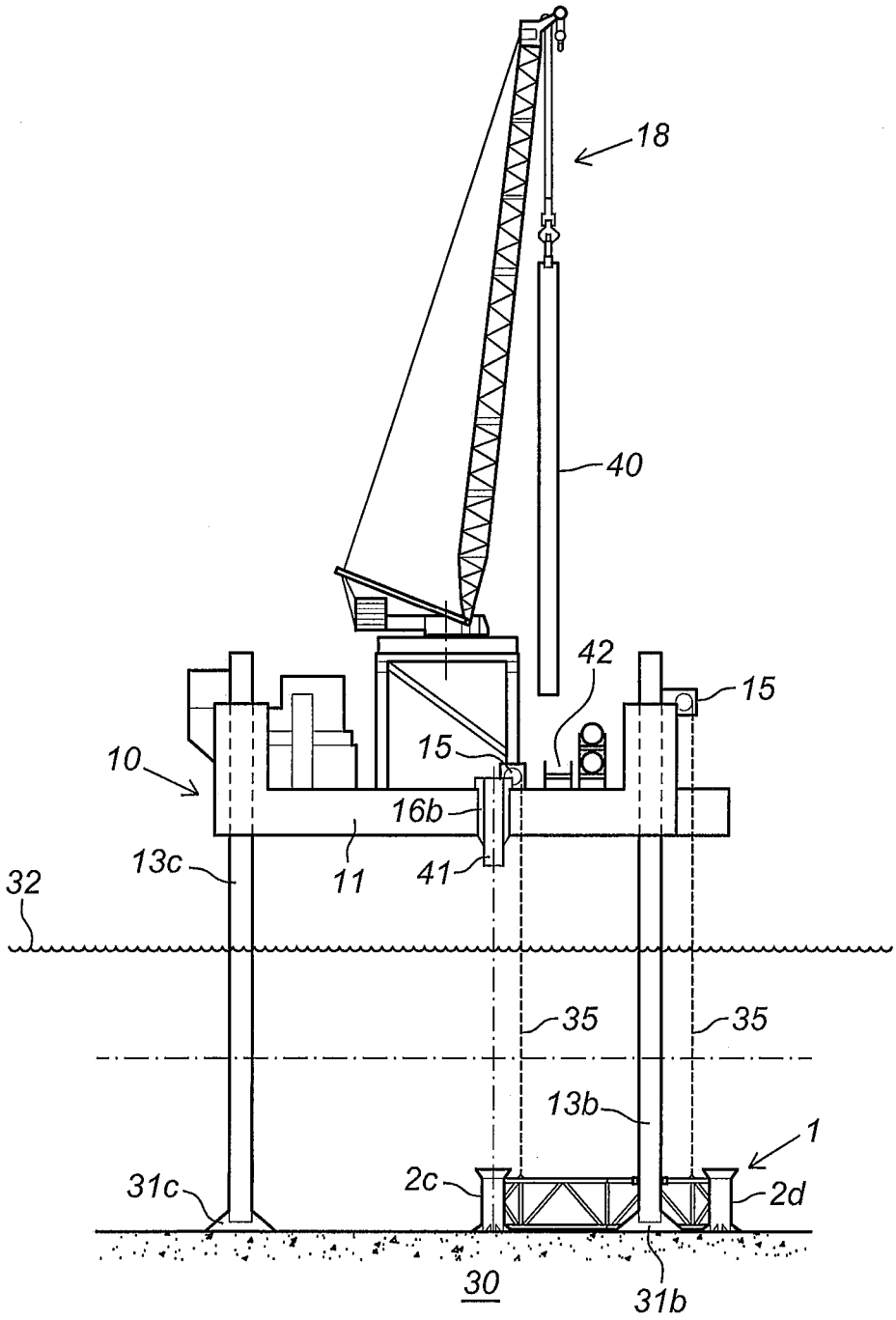

As shown in FIG. 7, positioning framework 1 is then lowered with winches 15 below the water surface to a position of use, in which positioning framework 1 rests at least partially on underwater bottom 30 as shown in FIG. 8. During lowering the positioning framework 1 will slide with the U-shaped forks (8*a*, 8*b*) along spud poles (13*a*, 13*b*) so that its position in relation to platform 10 substantially does not change (except for the vertical position). Winches 15 operate independently of each other and are controlled such that positioning framework 1 is displaced substantially horizontally parallel to the spud poles. This ensures that foundation piles will be driven in a substantially vertical direction into underwater bottom 30, irrespective of the height profile of bottom 30.

A pile lining tube 41 is then picked up by lifting crane 18 and placed in moon pool 16*b* above the desired position 33 of the first pile as shown in FIG. 8.

Figure 10:
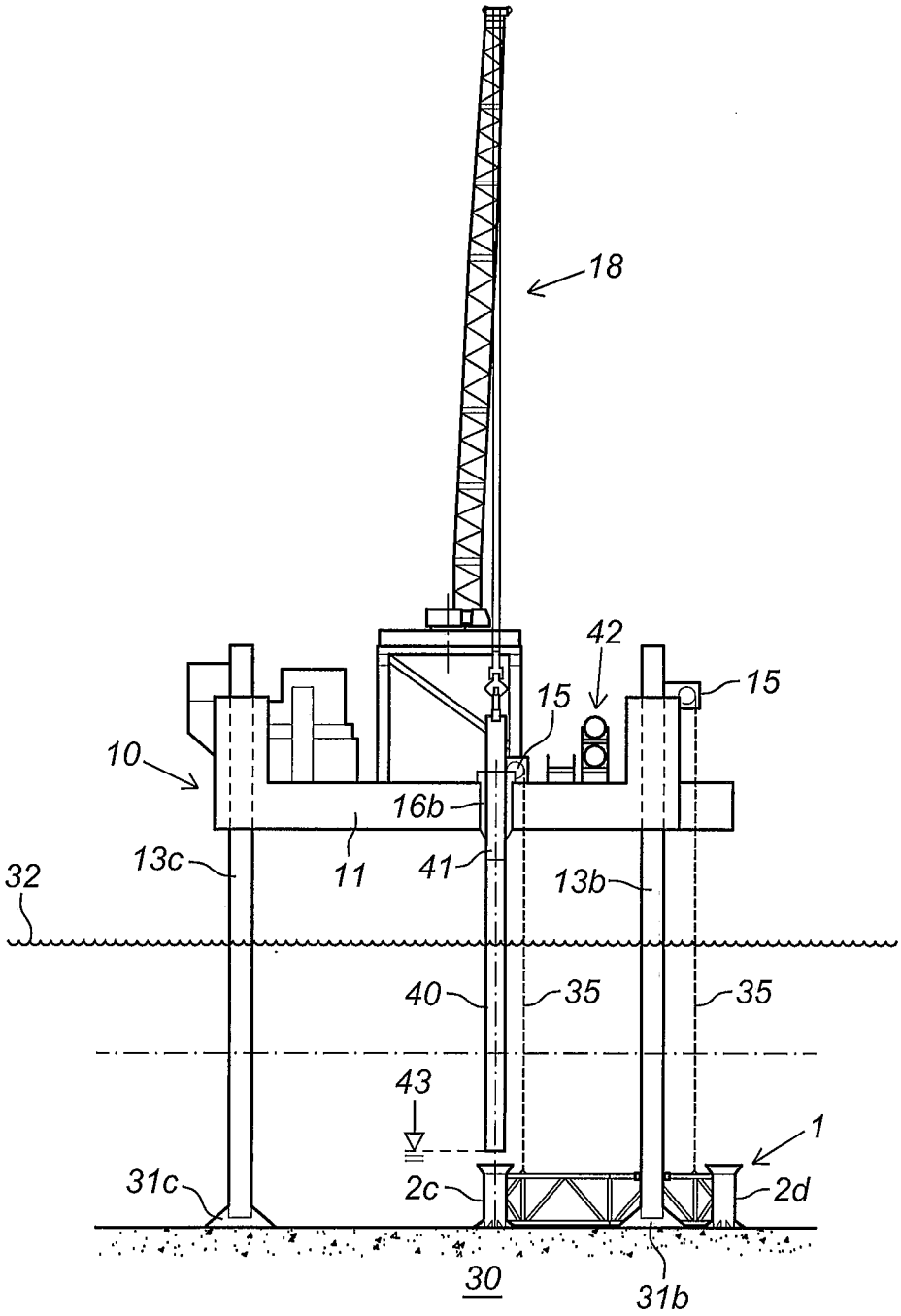
Figure 11:
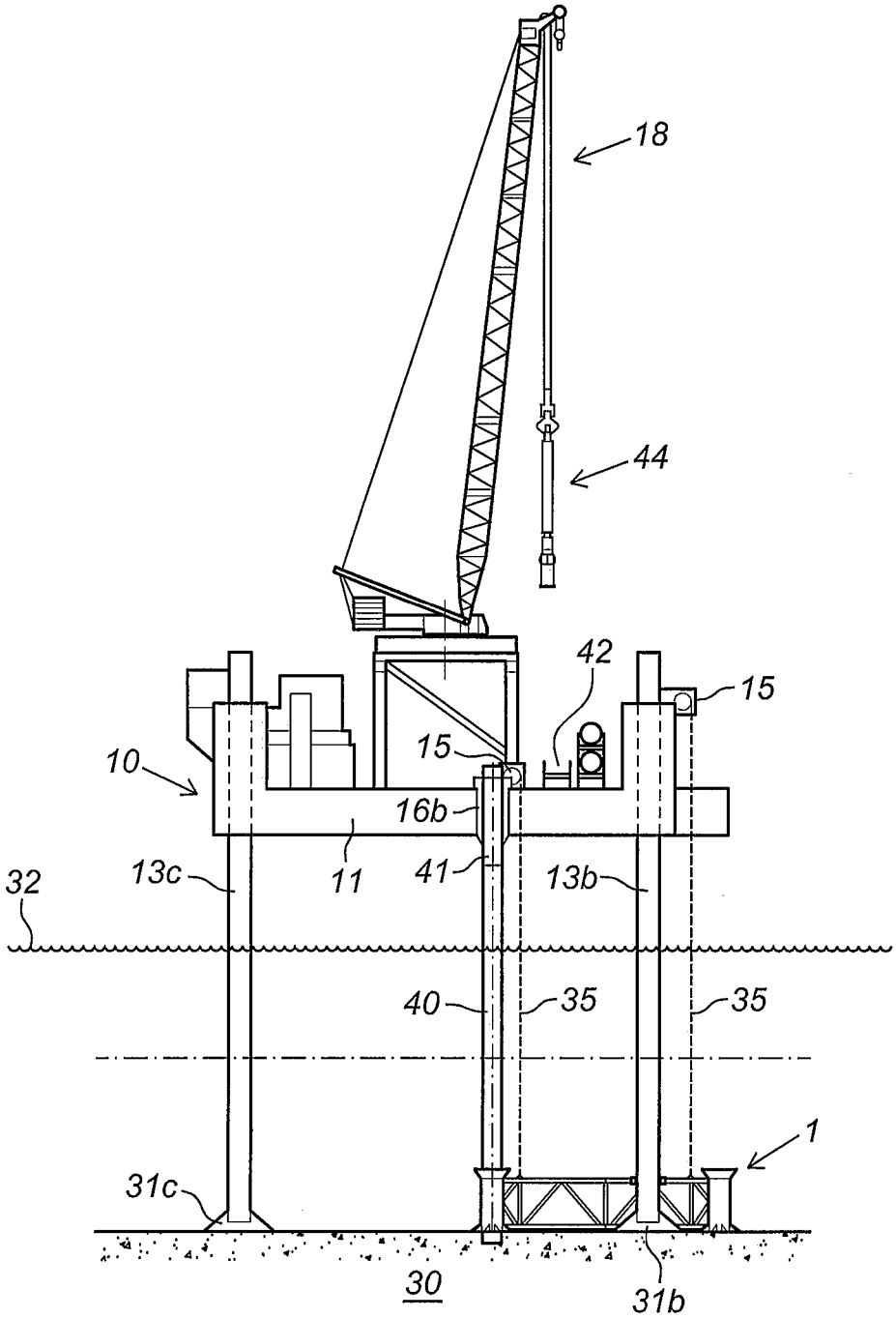

In a subsequent step of the method (see FIG. 9) a pile 40 is picked up by lifting crane 18 from a storage rack 42 and lowered into the lining tube 41 received in moon pool 16*b* until the underside of pile 40 is situated at the level 43, this level being close to the level of the underwater bottom (see FIG. 10).

Once pile 40 has been correctly aligned with guide tube 2*c*, the pile is lowered further until it is partially received in tube 2*c*. The support ribs (253, 354 or 452) are brought into the radially inward support position for pile 40, after which pile 40 is driven further into underwater bottom 30, wherein pile 40 is supported and guided by the support ribs of guide tube 2*c* (see FIG. 11).

Figure 12:
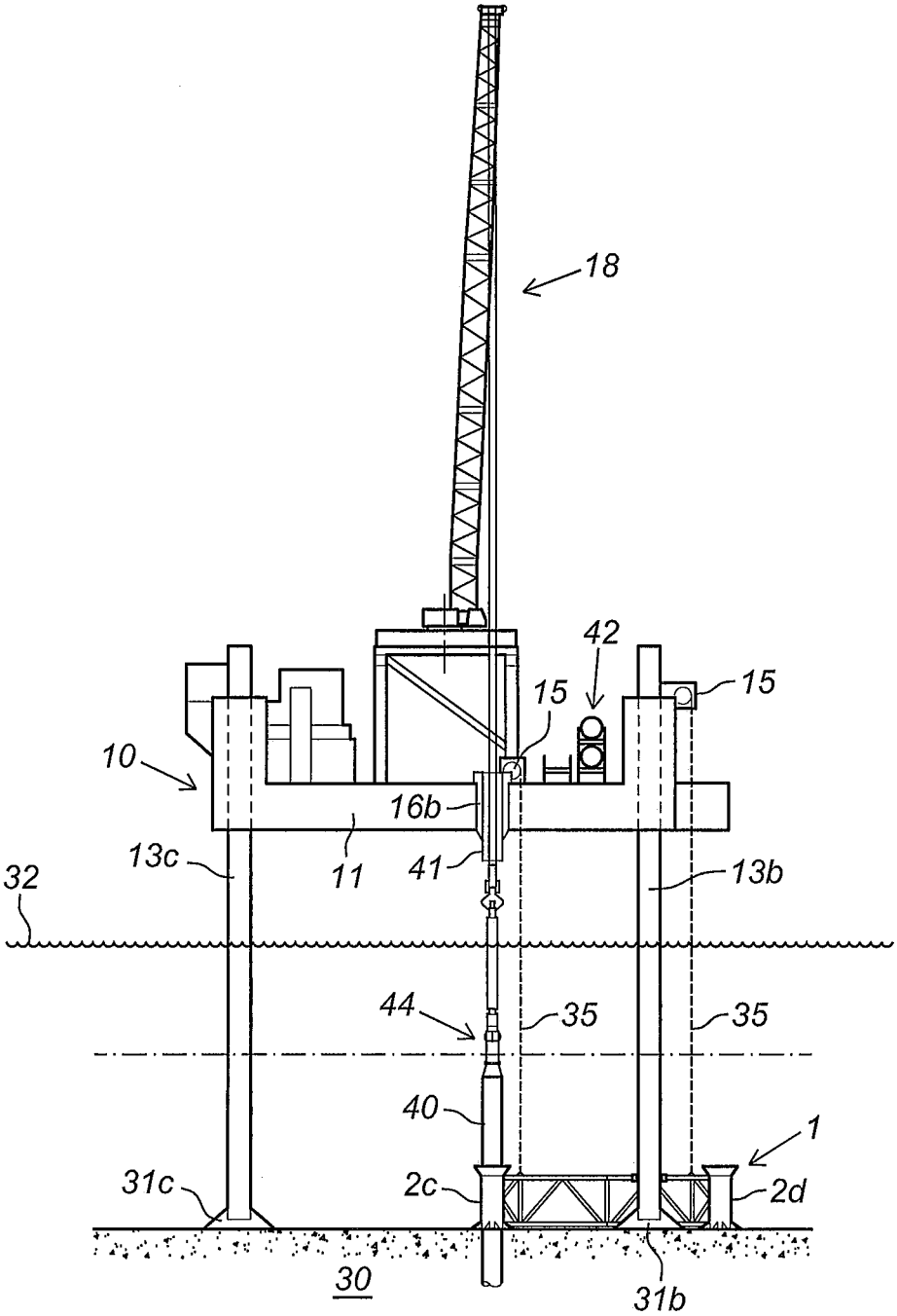

As shown in FIG. 12, pile 40 is driven into underwater bottom 30 until the top of pile 40 has penetrated far enough into guide tube 2*c*. Pile 40 can be driven into underwater bottom 30 by means of a pneumatic or hydraulic hammer 44.

The above described sequence of method steps is then repeated a number of times, depending on the desired number of foundation piles which must be arranged in underwater bottom 30. Because guide tubes (2*a*, 2*b*, 2*c*, 2*d*) of positioning framework 1 are automatically situated in the correct positions, all piles can be driven in efficient manner into underwater bottom 30 without losing time in determining the position for each individual pile. Once all piles 40 have been arranged in underwater bottom 30, at least the difference in height between the piles 40 present in the guide tubes (2*a*, 2*b*, 2*c*, 2*d*) is determined by means of the above described measuring device 25. If desired, positioning framework 1 can then be removed by being lifted along spud poles (13*a*, 13*b*) from the position of use to the rest position close to work deck 11 of platform 10 using winches 15 and lifting cables 35.

Figure 13:
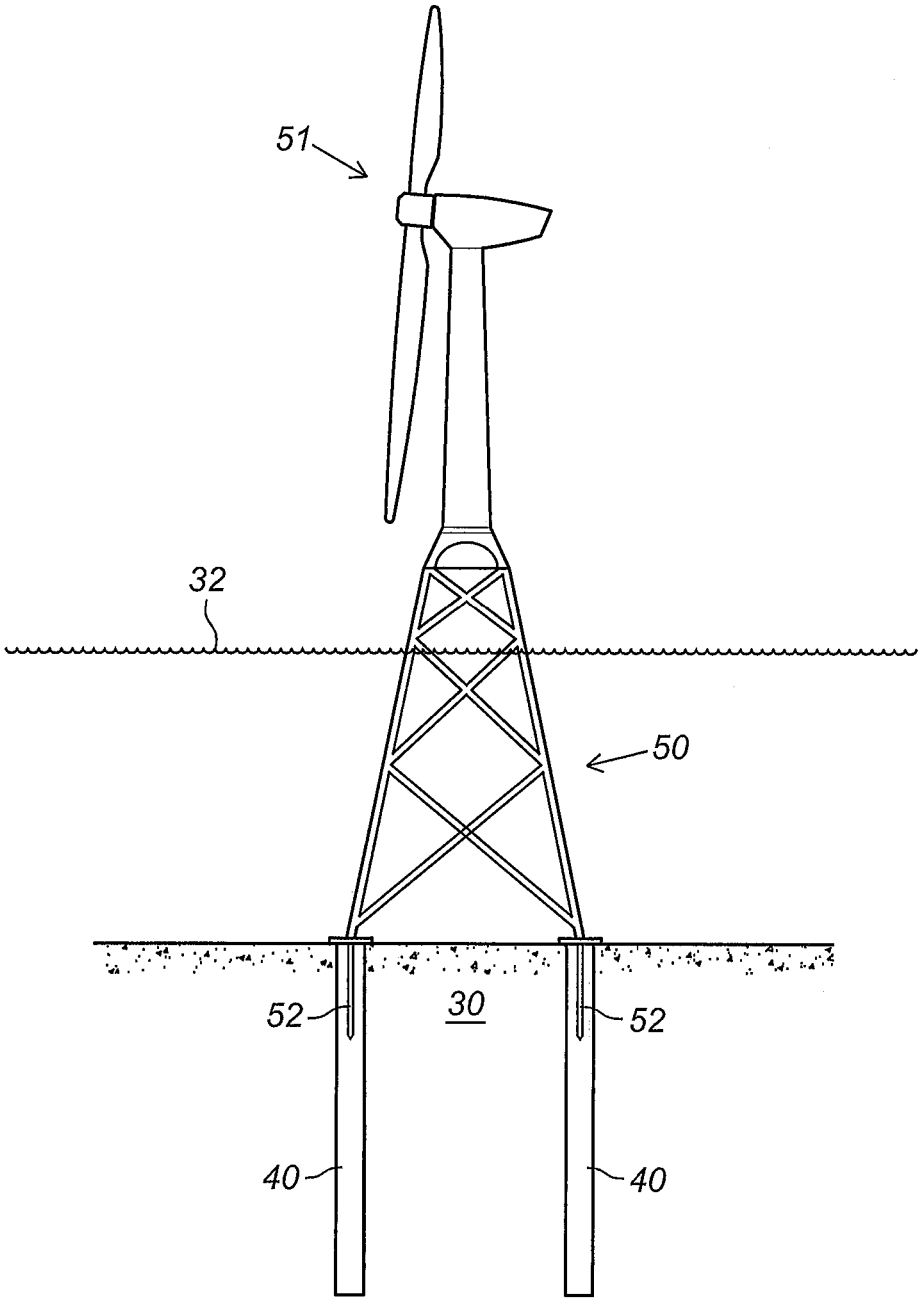
FIG. 13 shows schematically a jacket of a wind turbine placed according to the invention on a foundation of piles.

Referring to FIG. 13, a jacket 50 of a wind turbine 51 can be placed on the foundation realized as described above. This can take place for instance by arranging legs 52 of jacket 50 in or around piles 40 and anchoring the legs 52 to piles 40 by means of grouting. Because according to the invention the exact differences in height between upper edges 40*a* of piles 40 are known, such a jacket can be placed in more accurate manner, wherein it becomes possible to make the inclination of the jacket relative to the vertical direction even smaller than 1° if desired. The invented method is less dependent on weather conditions and requires in principle no extensive inspection operations underwater, for instance by robots and/or divers.

The invention claimed is:

1. A device for manufacturing a foundation for a mass located at height, wherein the foundation comprises a quantity of piles driven into an underwater bottom in a geometric pattern, which device comprises a positioning framework of a number of mutually connected guide tubes arranged in the geometric pattern and adapted to receive and guide a pile to be driven into the underwater bottom, wherein the guide tubes comprise measuring means adapted to determine the height of a pile present in the guide tubes, wherein the measuring means comprise a liquid gauge adapted to measure the vertical height of a stop, whereby the stop can be coupled to the pile and is movable from a lower reference height up to at least the upper edge of a pile present in the guide tube.

2. The device as claimed in claim 1, wherein the measuring means in conjunction with the displacement meter also comprise a liquid height difference meter, which substantially comprises liquid containers which are arranged on the guide tubes and which are mutually connected with a ring conduit, wherein the liquid containers are provided with liquid level meters.

3. The device as claimed in claim 1, wherein the stop is movable in the radial direction of the guide tube from a rest position, at a radius larger than the radius of the pile, to a measuring position at a radius smaller than the radius of the pile.

4. The device as claimed in claim 3, wherein the stop is coupled movably to a vertical support rib provided on the outer side of the guide tubes, and the peripheral casing of the guide tubes comprises recesses in which the stop can be received at least from the lowest reference height up to a measuring height.

5. The device as claimed in claim 4, wherein the stop is connected to the measuring rule for pivoting around a horizontal axis and can be carried from the rest position to the measuring position (and vice versa) by rotation around this axis.

6. The device as claimed in claim 1, wherein the measuring means comprise an inclinometer which is adapted for placing on the upper edge of a pile driven into the underwater bottom.

7. The device as claimed in claim 1, wherein the measuring means comprise a number of optical cameras.

8. The device as claimed in claim 1, wherein the positioning framework is provided with lifting cables for the purpose of carrying the positioning framework from a high position to a lower position optionally onto or into the immediate vicinity of the underwater bottom, wherein the measuring means comprise a strain gauge for measuring the strain in the lifting cables.

9. The device as claimed in claim 1, wherein the device is coupled to a jack-up platform to form an assembly.

10. A method for manufacturing a foundation for a mass located at height, wherein the foundation comprises a number of piles driven in a geometric pattern into an underwater bottom, the method comprising:

providing the assembly according to claim 9;

lowering the positioning framework from a high position in the immediate vicinity of the work deck of the platform to a lower position on or in the immediate vicinity of the underwater bottom;

driving the piles into the underwater bottom through the guide tubes of the positioning framework in the lower position; and measuring at least the difference in height between the piles present in the guide tubes by means of the measuring device.

11. The method as claimed in claim 10, comprising the step of removing the positioning framework once at least the height difference has been measured, wherein the removal of the positioning framework is performed by lifting of the positioning framework from the lower position to the high position in the vicinity of the work deck of the platform.

12. The method as claimed in claim 11, wherein the positioning framework is lifted with guiding by the spud poles of the platform.

13. The method as claimed in claim 10, wherein the mass located at height comprises a jacket of a wind turbine or a jetty.

14. The method as claimed in claim 10, wherein the positioning framework is lowered along the spud poles of the platform.

15. A method for installing on a foundation a mass located at height, wherein the foundation comprises a number of piles arranged according to the method as claimed in claim 10 in an underwater bottom, the method comprising of arranging legs of the mass located at height into or around the piles and anchoring the legs to the piles by means of grouting.

16. A device for manufacturing a foundation for a mass located at height, wherein the foundation comprises a quantity of piles driven into an underwater bottom in a geometric pattern, which device comprises a positioning framework of a number of mutually connected guide tubes arranged in the geometric pattern and adapted to receive and guide a pile to be driven into the underwater bottom, wherein the guide tubes comprise measuring means adapted to determine the height of a pile present in the guide tubes, wherein the measuring means comprise a displacement meter adapted to measure the displacement of a stop, whereby the stop can be coupled to the pile and is movable from a lower reference height up to at least the upper edge of a pile present in the guide tube.

17. The device as claimed in claim 16, wherein the measuring means, in conjunction with the displacement meter, also comprise a liquid height difference meter, which substantially comprises liquid containers which are arranged on the guide tubes and which are mutually connected with a ring conduit, wherein the liquid containers are provided with liquid level meters.

18. The device as claimed in claim 16, wherein the stop is movable in the radial direction of the guide tube from a rest position, at a radius larger than the radius of the pile, to a measuring position at a radius smaller than the radius of the pile.

19. The device as claimed in claim 16, wherein the measuring means comprise an inclinometer which is adapted for placing on the upper edge of a pile driven into the underwater bottom.

20. The device as claimed in claim 16, wherein the measuring means comprise a number of optical cameras.

21. The device as claimed in claim 16, wherein the mass located at height comprises a jacket of a wind turbine or a jetty.

* * * * *